US008376808B2

(12) United States Patent
Hopkins

(10) Patent No.: US 8,376,808 B2
(45) Date of Patent: Feb. 19, 2013

(54) SPORTS BRA WITH INTEGRAL FITTED SAUNA SUIT

(76) Inventor: Natascha Hopkins, Beverly Hills, CA (US)

( * ) Notice: Subject to any disclaimer, the term of this patent is extended or adjusted under 35 U.S.C. 154(b) by 0 days.

(21) Appl. No.: 12/805,102

(22) Filed: Jul. 13, 2010

(65) Prior Publication Data

US 2012/0142252 A1 Jun. 7, 2012

(51) Int. Cl.
*A41C 3/00* (2006.01)

(52) U.S. Cl. ..... 450/30; 450/33; 2/69

(58) Field of Classification Search ..... 450/30–33, 450/28, 1, 8, 17, 26, 34, 5, 10, 11, 25, 21, 450/66, 75–79, 70; 2/73, 69, 113–115, 104–106, 2/221, 96, 67
See application file for complete search history.

(56) References Cited

U.S. PATENT DOCUMENTS 4,187,855 A * 2/1980 Paulus et al. ..... 450/3
4,854,915 A * 8/1989 Luedy ..... 450/31
5,109,546 A 5/1992 Dicker et al.
5,176,600 A 1/1993 Wilkinson
5,186,701 A 2/1993 Wilkinson
5,201,074 A 4/1993 Dicker
5,306,222 A 4/1994 Wilkinson
5,570,472 A 11/1996 Dicker
5,700,231 A 12/1997 Wilkinson
5,708,976 A 1/1998 Dicker
5,720,042 A 2/1998 Wilkinson
5,727,254 A 3/1998 Dicker
5,737,772 A 4/1998 Dicker et al.
5,737,773 A 4/1998 Dicker et al.
5,778,452 A 7/1998 Dicker et al.
5,819,322 A 10/1998 Dicker et al.
5,839,122 A 11/1998 Dicker et al.
5,857,947 A 1/1999 Dicker
5,867,827 A 2/1999 Wilkinson
5,875,491 A 3/1999 Wilkinson
6,083,080 A * 7/2000 Lawson et al. ..... 450/39
6,180,178 B1 * 1/2001 Vogt ..... 427/389.9
6,231,488 B1 5/2001 Dicker et al.
6,238,266 B1 * 5/2001 Vogt ..... 450/19
6,464,717 B1 * 10/2002 Smith et al. ..... 607/108
6,860,789 B2 * 3/2005 Bell et al. ..... 450/20
7,144,294 B2 * 12/2006 Bell et al. ..... 450/20
7,396,272 B1 * 7/2008 Newlen ..... 450/54
7,549,971 B2 * 6/2009 Bell et al. ..... 602/75
7,628,675 B2 * 12/2009 Staub ..... 450/28
7,922,682 B2 * 4/2011 Bell et al. ..... 602/75

* cited by examiner

*Primary Examiner* — Gloria Hale
(74) *Attorney, Agent, or Firm* — Brooks Kushman, PC; Roland Tong

(57) ABSTRACT

An aerobic activity garment structure comprising a shirt portion including a water resistant material adapted to promote perspiration; a sports bra integrated with the shirt portion, the sports bra including an elastic polymeric material for increased support of the breasts; a base portion attached to the shirt portion; a zipper for securement of the garment to a wearer, the zipper spanning from the shirt portion to the base portion; and a moisture-absorbent material lining attached to the base portion, the moisture-absorbent material lining adapted to absorb the perspiration.

2 Claims, 4 Drawing Sheets

SPORTS BRA WITH INTEGRAL FITTED SAUNA SUIT

BACKGROUND OF THE INVENTION

A common article of apparel favored by women athletes and active women is the 'sports bra,' a garment intended both to robustly support the breasts during vigorous activity and permit freedom of motion of the arms, shoulders, head, neck, and torso. Another apparel item sometimes worn by persons wishing to accelerate water weight loss through sweating during vigorous physical activity is the non-breathable garment commonly known as the 'sauna suit' or 'sweat-suit.' Although there seems to be a lag in the onset of sweating at the beginning of exercise, it has been well documented that sweating (evaporation) provides the major physiologic defense against overheating. Heat is continually being evaporated through the skin into the environment as water.

The sweating rate of any given individual is dependent upon the climatic conditions/environmental acclimation, the type of clothing worn, and the level of exercise intensity. (Sawka, et al., 1998.) Sawka, et al. conclude that persons wearing protective clothing often have sweating rates of 1 to 2 liters per hour while performing light intensity exercise. Protective clothing such as the nuclear, biological, and chemical (NBC) ensemble worn by military personnel, the protective equipment worn by football players, or the sauna suit features high insulation and low water vapor permeability, due to the thickness and the multilayered fabric design.

This layering effect traps insulative air layers around the body and impairs the transfer of heat to the environment. The limited evaporative heat loss allowed by the protective clothing, combined with an increased metabolic heat production and high ambient temperature, can increase the body's core temperature to dangerously high levels. These conditions define uncompensable heat stress wherein the evaporative cooling requirements (E.sub.req) greatly exceed the maximum evaporative potential (E.sub.max), which maintains thermal equilibrium.

It is not uncommon, therefore, for conditions that would normally be defined as compensable heat stress, to become uncompensable when protective clothing is worn (McLellan, et al., 1999). The heat strain associated with wearing NBC protective clothing has been studied for many different combinations of ambient temperature, vapor pressure, and metabolic rate (Carter and Cammermyer, 1985); Kraning and Gonzalez, 1991; McLellan, 1993; Montain, et at. 1994). U.S. Pat. No. 6,231,488 issued on May 15, 2001 to Dicker, et. al. entitled "Aerobic Exercise Garment") discloses an aerobic resistance garment is particularly designed for warm weather or indoor or high temperature use by including elastic resistance bands and base fabric material wherein the base fabric material is breathable such as by being made from an open mesh or net material. If desired, at least a portion of the midriff may be bare.

Various garments have been suggested which include elastic elements to provide a resistance to an activity which would require swinging or bending of the arms or legs or the bending of various body parts. Examples of such garments are found in U.S. Pat. Nos. 5,109,546, 5,176,600, 5,186,701, 5,201,074, 5,306,222 and 5,570,472. One deficiency of current sauna suit designs is that they are generally baggy, unfitted garments designed as a unisex or one size fits all item. No known sauna suits provides integrated support for the breasts, thereby requiring that a bra or sports bra be worn underneath the sauna suit to insure adequate support during physical activity. This is a further deficiency which requires the wearer to don undergarments first, then the sauna suit.

A further deficiency of current designs is that many undergarments are not designed to endure the high degree of saturation in sweat which occurs when worn with a sauna suit, and may therefore be damaged, or garment life significantly reduced. A further additional deficiency is that some individuals may choose to wear a sauna suit under 'regular' clothing, in order to continue the accelerated water weight loss process while engaged in activities requiring 'normal' clothes; and as most sauna suits are quite baggy and un-fitted, the ability to comfortably conceal them under 'regular' clothing is limited at best. One additional deficiency of current designs is the lack of an absorbent lining to absorb sweat, thereby preventing it from running down the user's body and possibly wetting or staining their clothing or footwear.

There are many known sports bras and sauna suits, but each suffers deficiencies when an attempt is made to utilize them together, particularly under clothing. There is no known garment which combines the functionality and benefits of a sports bra, a sauna suit, and a fitted garment which may be worn alone or under clothing. While the deficiencies mentioned above are well known, there has never been an attempt to remedy them with a single integrated solution.

Accordingly, those skilled in the art have recognized a significant need for aerobic garments to act as a fitted sauna suit, thereby permitting the garment to be worn under clothing. There is also a need for a fitted sauna suit which facilitates an aesthetically pleasing shape to and support for the wearer's breasts, buttocks, and torso, and/or thighs. Moreover, the art has recognized a need for such garments to have an absorbent material to absorb the sweat produced by the user to avoid introduction of sweat into the user's clothing or footwear. It is also desirable, if not mandatory, that such fitted sauna suits can tolerate the conditions of use including high moisture exposure and robust activity. The present invention fulfills such needs.

SUMMARY OF THE INVENTION

A variety of unique aerobic garment structures for use in warm weather or high temperature conditions is provided. The garment structure comprises a shirt portion having a body portion with an integral sports bra. The garment structure may take the form of a fitted sauna suit with a base skirt having a zipper or other closure for securement. Preferably, the sports bra comprises a second layer of fitted polymeric material, such as clothing material sold under the trademark LYCRA®, for increased support of the breasts and is cut upward to create a moderate lift and extra security for the wearer. A water resistant material with elastic properties such neoprene may be used for the garment structure, or portions thereof to promote water weight loss through perspiration and to provide for a comfortable fit for the wearer. Optionally, a moisture-absorbent material lining on the sports bra portion or other areas of the garment may be included to absorb excess moisture and for increased comfort. A pants portion in the form of shorts or longer leggings may also be made of a base fabric with a trunk portion and legs. Each of the shirt portion and pants portion may include styled openings for receiving the arms and legs of the wearer. Accordingly, the invention allows the advantageous modality of donning and wearing a single integrated garment which provides support, comfort, freedom of motion to promote accelerated water weight loss.

A fitted sports bra with integral sauna suit embodying the principles of this invention solves the problems of integrating a supportive sports bra with a sauna suit, while accommodating the constraints of form fit permitting it to be easily and comfortably worn beneath clothing. It employs a design and structure in the bra cups, which create both support for and a pleasing appearance of the breasts, as well as a form fitted and stretchable sauna suit portion which encloses the entire torso in a non-breathable material to promote accelerated water weight loss through sweating.

In general, the aerobic resistance garment would be made from two different types of materials having different elastic characteristics. It is essential that one of the materials that functions as the elastic resistance elements or bands have a greater resistance force that must be overcome by the user while wearing the garment. The other material could have some degree of elasticity and could be made of the types of materials noted in the aforementioned patents. The base material for the garment would be selected so as to provide comfort to the user. Such material could be a stretch material having four-way or two-way stretch, preferably using a LYCRA® spandex yarn. Other examples are DuPont's textile materials sold under the trademarks TACTEL® and SUPPLEX®.

The garment may comprise moisture absorbent materials at pre-selected locations, for instance in the under cups of the sports bra. The garment having such materials maybe formed from one or more moisture wicking fabrics and may include a water-absorbent material polyvinyl alcohol material surrounded by the moisture-wicking fabric. A preferred water-absorbent material may be polyvinyl alcohol towel or chamois.

In one embodiment, the water-absorbent material is enclosed in a pouch or pocket in the fabric, preferably the pouch or pocket is positioned to contact a surface of a user's body. In another embodiment, the water-absorbent material can be placed into a fold in the fabric or a liner within the clothing article. Generally, such bands have anchor structure in order to function as an aerobic garment. For example, where used in the shirt portion of the garment the anchor structure might be at the ends of the arms, such as at the hands or wrists. Where used in the pants portion of the garment the anchor structure might be at the legs or feet and might also be at the shoulders. Others locations of anchor structure might also be used with the practice of this invention. For example, a pants portion may terminate at the waist and anchor structure could be provided at the waist. A pants portion might also terminate in the general area of the knees and the anchor structure could be provided at, above or below the knees. With regard to the shirt portion the elastic band could extend from arm to arm with the anchor structure at each arm. Alternatively, the elastic band could extend from one arm to a further portion of the garment such as on the torso, neck or shoulder area and be provided with anchor structure at that area.

In general, the aerobic garment would be made by first designing the garment and determining the body dimensions. Next, the fabric would be selected and patterns would be made. Preferably the first sample would be cut and sewn and then fitted. After this testing any errors in the patterns would be corrected. A second sample would then be cut, sewn and fitted and corrections made for fit, function and patterns. The patterns would be grade and markers made. Specification sheets would be set up and sewing sheets would be created. Cutting tickets would be written and the final garments would be cut and sewn.

In general, the basic fabric would have its section sewn together to form a base unit. The moisture-absorbent materials may be then incorporated into the basic garment by being sewn at the appropriate locations to form a final garment section.

Variations

There are many possible variations of the version described above. One variation is a suit which encloses the entire body including long sleeves and full pant legs. A second variation is a suit which covers only the abdomen. Variations in length of the sweat skirt may accommodate a wide range of requirements and applications.

In broad embodiment, the present invention is a sauna suit with integrated sports bra and integrated sweat absorbing panel which affords the user a supportive, aesthetically flattering, and highly functional water weight loss promoting garment. Implementations following the principles of this invention allow the advantageous modality of donning and wearing a single integrated garment which provides support, comfort, freedom of motion and promotes accelerated water weight loss. Examples of implementations consistent with this invention include sports bras with a torso length sauna suit, a 'jacket' style garment with integral sports bra and long sleeves, and a sports bra or jacket style garment with a sauna suit which extends over the thighs, or integrates shorts or full length pants. This summary is intended to introduce the inventive concepts, principles and embodiments, not to define them.

DESCRIPTION OF THE PREFERRED EMBODIMENTS

Figure 1:
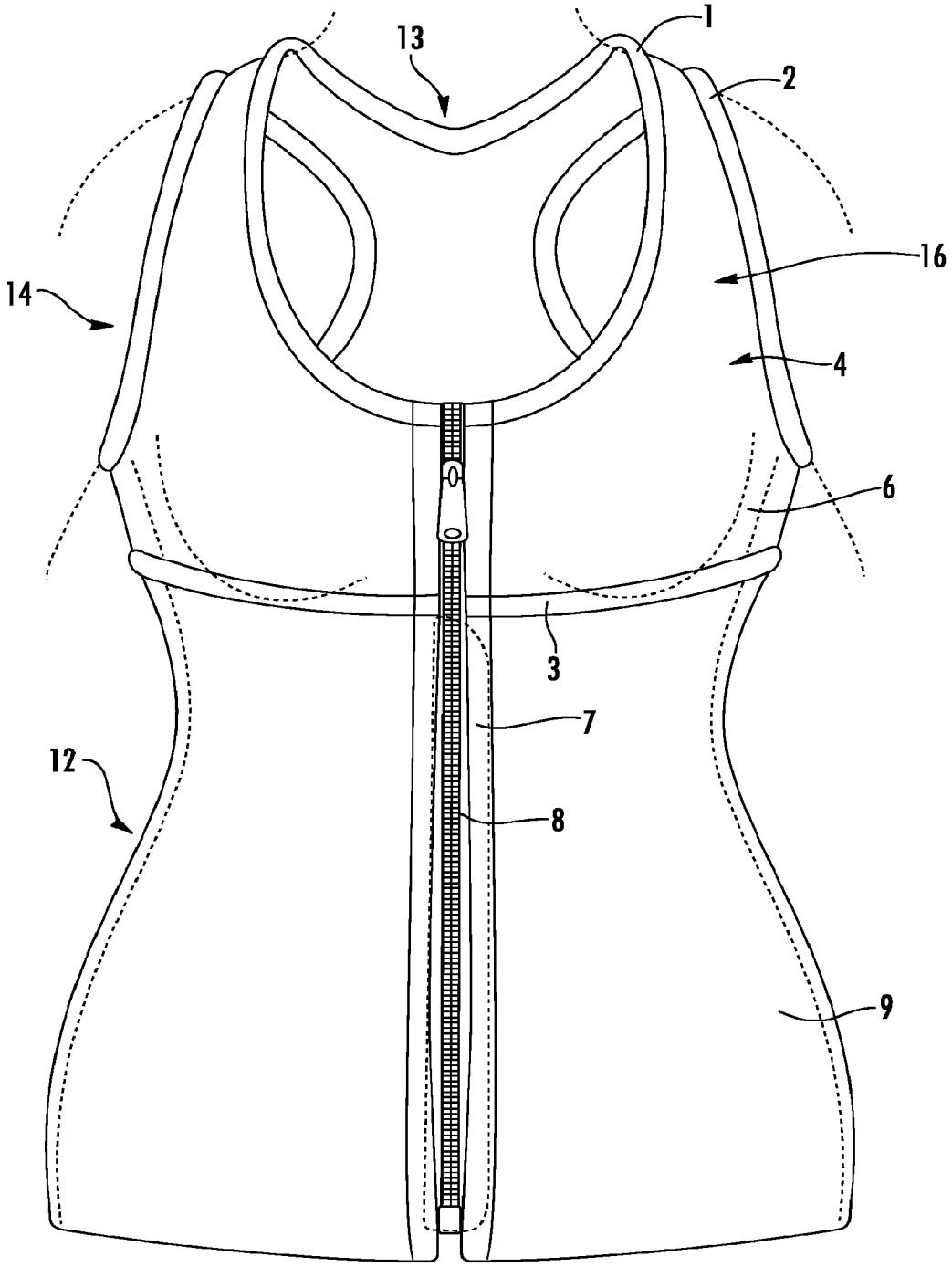
FIG. 1 is a frontal view of a garment embodying teachings of the present disclosure in the closed or zipped configuration.

A variety of unique aerobic garment structures for use in warm weather or high temperature conditions is provided. In FIG. 1, the garment structure comprises a shirt portion 16 having a body portion with an integral sports bra 4. The garment structure may take the form of a fitted sauna suit 12 with a base skirt having a zipper 8 or other closure for securement. Preferably, the sports bra 4 comprises a second layer of fitted polymeric material 6, such as the clothing material sold under the trademark LYCRA®, for increased support of the breasts and configured to create a moderate lift and extra security for the wearer. A water resistant material 9 with elastic properties such neoprene may be used for the garment structure, or portions thereof, such as the base skirt 9, to promote water weight loss through perspiration and to provide for a comfortable fit for the wearer.

Figure 2:
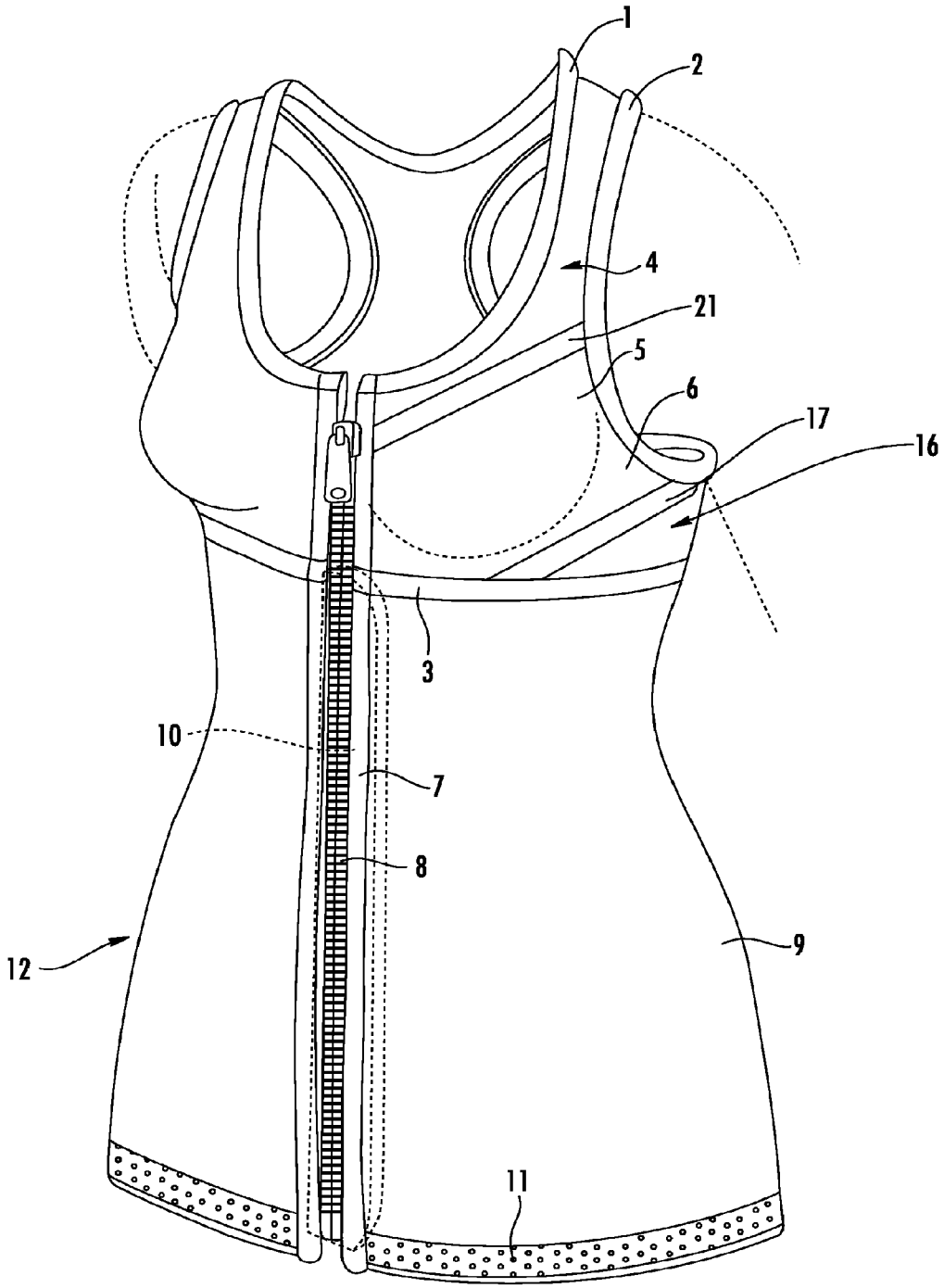
FIG. 2 is a perspective view of the garment of FIG. 1.

Optionally, a moisture-absorbent material lining 1 on the sports bra portion or other areas of the garment may be included to absorb excess moisture and for increased comfort (FIG. 2). A pants portion in the form of shorts or longer leggings may also be made of a base fabric with a trunk portion and legs (not shown). Each of the shirt portion and pants portion may include styled openings for receiving the arms and legs of the wearer. Accordingly, the invention allows the advantageous modality of donning and wearing a single integrated garment which provides support, comfort, freedom of motion to promote accelerated water weight loss.

The present invention provides an aerobic resistance garment for use in warm weather or high temperature conditions comprising a shirt portion 16 having a body portion and arms, said shirt portion being in the form of a sports bra made of open mesh/net base fabric material, a pants portion in the form of shorts made of a base fabric with a trunk portion and legs (not shown), each of said shirt portion and said pants portion including at least one elastic resistance band 17, 18, 19, and 21 requiring force to stretch said band and resist said band from returning to its unstretched condition (not shown), said sports bra portion being spaced from said trunk portion to provide a bare midriff when in use, wherein said shirt portion includes sleeves, said elastic resistance bands extending across said body portion and down said sleeves, and each of said sleeves having a compression anchoring cuff, and an end of said band being secured to said anchoring cuff.

In conjunction with the included drawings, this detailed description is intended to impart an understanding of the teachings herein and not to define their metes and bounds. One particular implementation illustrating aspects of the present teaching is presented in detail below. Some of the many possible variations and versions are also described. As used in this document, the terms of up, upward, down, and downward are in reference to a garment worn by a person standing upright.

One version of a garment consistent with the teachings herein and which has a sports bra with integral fitted sauna suit is seen in FIG. 1. Referring back to FIG. 1, secured to the sports bra 4, is a fitted sauna suit 12 consisting of a base skirt 9 with adjoining strip 3 securing the sports bra 4 and the fitted sauna 12. Zipper 8 provides an ingress and securement means for donning the garment Inner elastic 1 and outer elastic 2 provide support for the breasts and finish the edges of neck opening 13 and arm opening 14 to present a smooth, comfortable, chafe resistant finish.

In the preferred embodiment of the present invention, a water resistant material 9 with elastic properties such as neoprene is used to form the major components of sports bra 4 and base skirt 9. The frontal elastic 7 combines the zipper 8 with the base skirt 9 and also used for comfort. The base skirt 9 is cut in a manner to reflect a corset shape of the torso area.

Referring now to FIG. 2, secured to the sports bra 4 is a fitted sauna suit 12 consisting of a base skirt 9 with adjoining strip 3 securing the sports bra 4 and the fitted sauna suit 12. Under the sports bra 4 is second layer of fitted material 6, such as the clothing material sold under the trademark LYCRA®, is used for extra support of the breasts and to create a moderate lift and extra security. A water resistant material with elastic properties such a neoprene is used to keep the function of promoting water weight loss through sweat. A neoprene flap 10 serves as a zipper shield and is adapted to keep the zipper 8 from touching the skin while zipping up or down and when worn. The water resistant material 9 with elastic properties such a neoprene is also used for comfort. An absorbent lining on the lower extremity of the garment 1, is an optional feature that is used to absorb the sweat, that will be caused from the fitted sauna suit 12. The absorbent lining 1 on the lower extremity of the garment, is also used for comfort.

Figure 3:
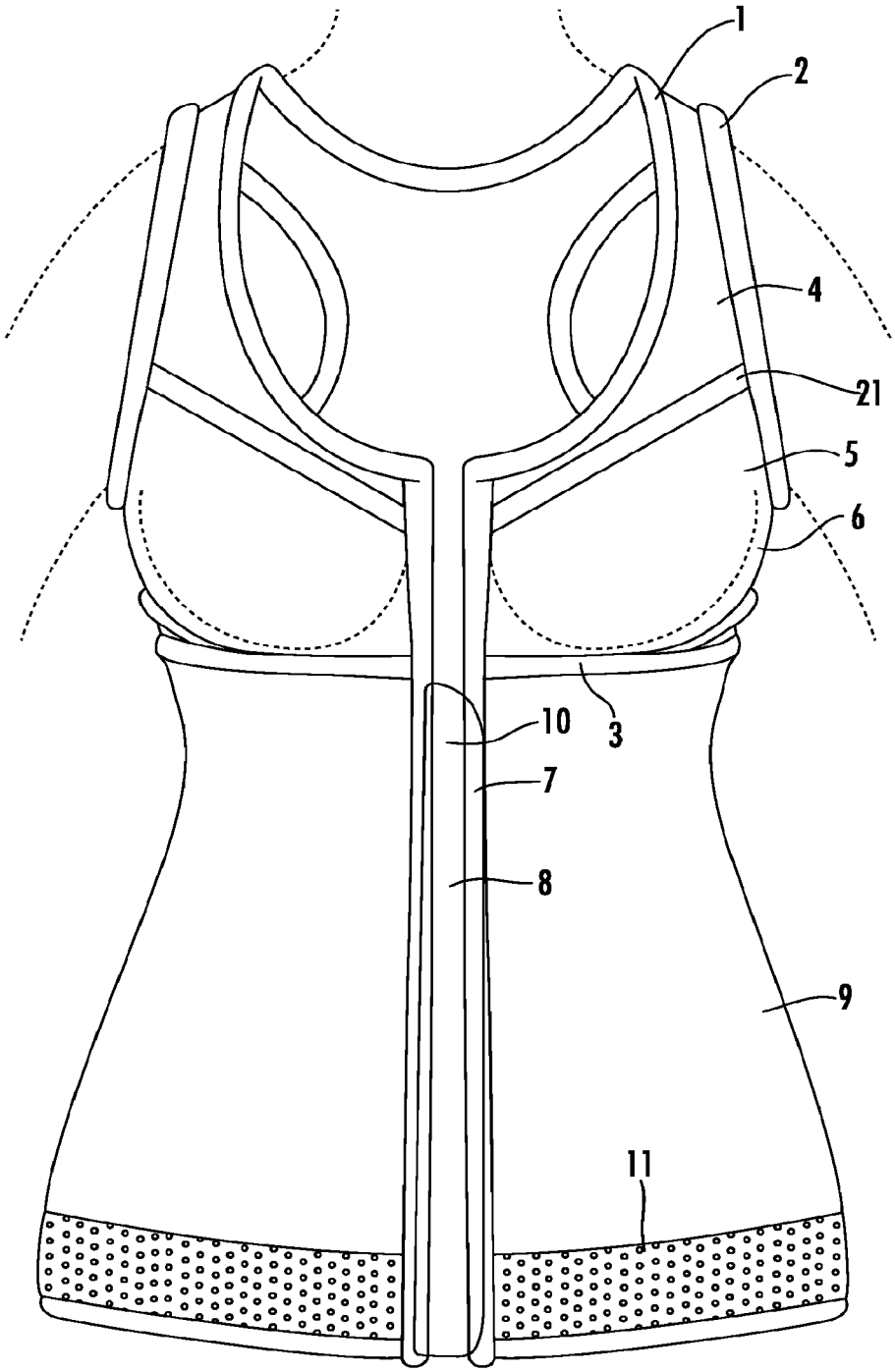
FIG. 3 is a front view of the garment of FIG. 1 in the reverse configuration illustrating zipper shield.
Figure 4:
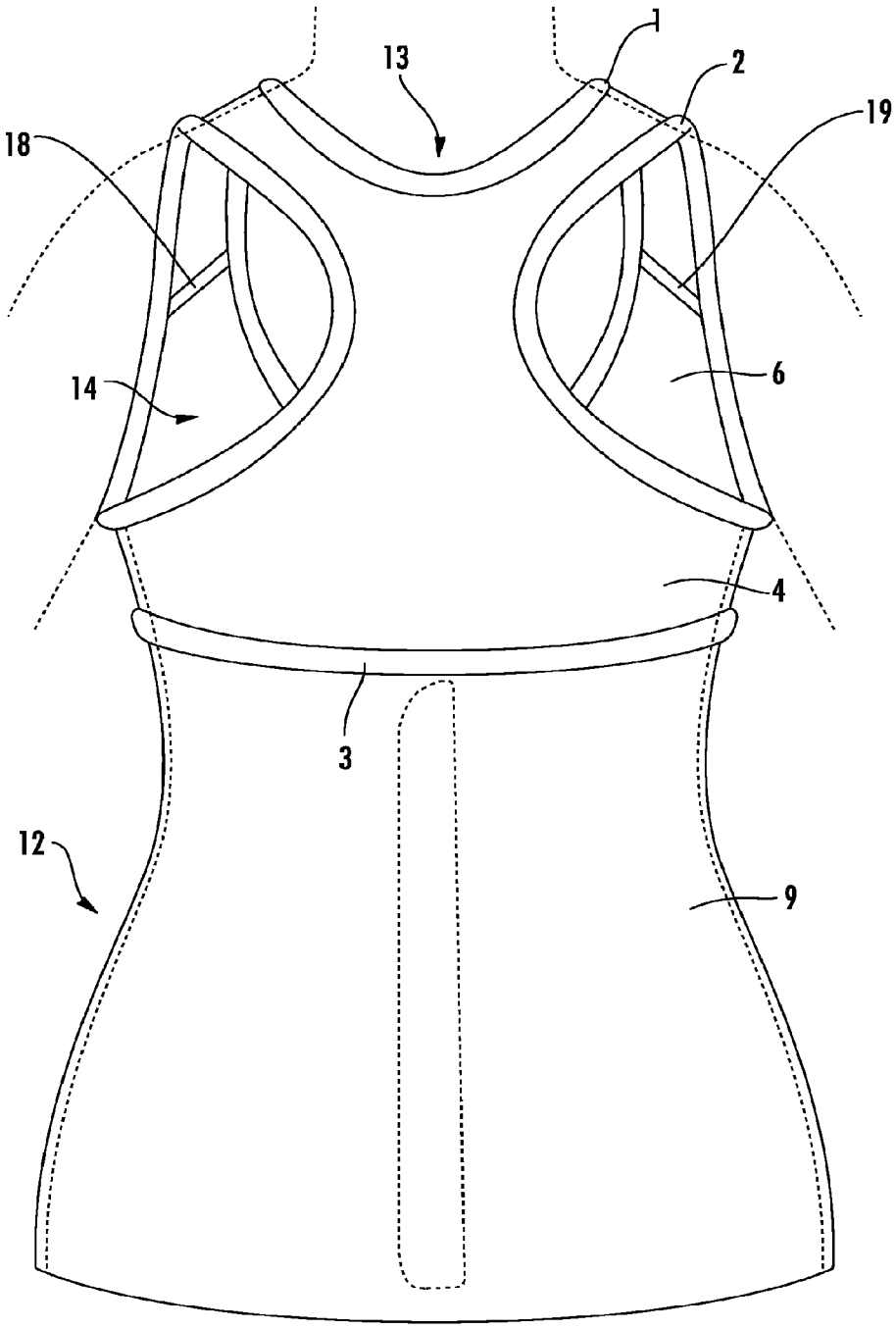
FIG. 4 is a rear view of the garment of FIG. 1.

Referring now to FIG. 3, secured to the sports bra 4 is a fitted sauna suit 12 consisting of a base skirt 9 with adjoining strip 3 securing the sports bra 4 and the fitted sauna suit 12. Between the sports bra 4 and the second layer of fitted material, such as the clothing material sold under the trademark LYCRA® 6, are the firm, dependable breast cups 5. The firm, dependable breasts cups 5 are used for extra hold and to keep the shape of the breasts.

A. Moisture-Wicking Fabrics

The clothing articles may be formed using any suitable moisture-wicking material. Moisture-wicking fabrics refer to any fabric made from a fiber that does not absorb moisture into the fiber, rather the moisture remains on the surface of the fiber and thereby promotes rapid evaporation. Suitable fabrics include polyester, polyester based fabrics, nylon, polypropylene, polyurethane, and blends or combinations thereof. The fabrics may be formed of natural materials, such as cotton, wool, silk, and linen. Fabrics may include a mixture of natural and/or synthetic materials. Preferred fabrics include polyester and blends thereof, such as nylon-Spandex. A number of moisture-wicking fabrics have been designed and are commercially available, such as the polyester-based fabric, COOLMAX®, Extreme by Invista, DRI-RELEASE®, fabric by Optimer, Inc. (e.g. 88% Polyester/9% Cotton/3% Spandex; or 85% Polyester, 15% Cotton), NANO-TEX® Coolest Comfort fabrics by Nano-Tex, Inc. (may be used with a variety of fabrics, including 100% cotton), and CLIMAGUARD®, a TEFLON®-impregnated fabric developed by ROTOFIL®.

The clothing articles contain one or more areas for placing a water-absorbent material, such as pockets, pouches, folds (e.g., a fold in the fabric, creating a pouch), inserts in the lining. The area for placing the water absorbent material may contain an open portion, such as on a top portion of the area. The open area may be closed using one or more fasteners. Any conventional fastener may be used, including but not limited to, snaps, clips, zippers, the strings, buttons, hooks and eyes, and hookand-loop materials, typically available under the VELCRO® trademark. The fastener is used to close or seal the area and keep the water-absorbent material inside the area, even during vigorous exercise.

III. Water-Absorbent Materials

The water-absorbent material absorbs at least approximately 10 times in weight in water, or aqueous solutions. In preferred embodiment, the water-absorbent material absorbs at least approximately 12 times in weight (dry) in water or aqueous solutions. Preferably the material absorbs up to 12 times its weight in water or aqueous solutions without feeling wet to a user. The water absorbent materials do not dissolve in water at standard temperatures and pressures. The water-absorbent material is typically in the form of a towel, pad or strip of material. Any suitable thickness may be used, preferably the water-absorbent material does not significantly increase the thickness of the overall clothing articles when placed in the pouch, fold or pocket. Thinner water-absorbent materials are generally preferred. Typical thicknesses range from up to 1 cm to up to 4 cm. In one preferred embodiment, the water-absorbent material typically has a thickness ranging from 2 cm to 4 cm. When worn by an individual, the clothing articles are particularly useful at preventing perspiration from running down a user's face, hands, back, or body.

The present invention relates to manufacturing techniques for incorporating elastic resistance bands into aerobic resistance garments. Reference is made to U.S. Pat. Nos. 5,109,546, 5,176,600, 5,186,701, 5,201,074, 5,306,222 and 5,570,472 and 5,570,472, and to U.S. patent applications, Ser. No. 08/627,426 filed Apr. 4, 1996; Ser. No. 08/660,098, filed Jun. 6, 1996; Ser. No. 08/734,736, filed Oct. 21, 1996; Ser. No. 08/761,290, fled Dec. 6, 1996; Ser. No. 08/777,453, fled Dec. 3, 1996; Ser. No. 08/802,972, filed Feb. 20, 1997; Ser. No. 08/802,973, filed Feb. 20, 1997; Ser. No. 08/834,887, filed Apr. 7, 1997; Ser. No. 08/840,917, filed Apr. 25, 1997; Ser. No. 08/880,715, filed Jun. 23, 1997; Ser. No. 08/892,669, filed Jul. 14, 1997, and Ser. No. 08/986,521, filed Dec. 8, 1997, all of the details of which are incorporated herein with reference thereto. Such patents and applications exemplify the general types of garments to which the manufacturing techniques maybe applied for making garments in accordance with this invention. Other more specific forms will be described in detail hereafter.

In general, the aerobic resistance garment would be made from two different types of materials having different elastic characteristics. It is essential that one of the materials which functions as the elastic resistance elements or bands have a resistance force that must be overcome by the user while wearing the garment. The other material could have some degree of elasticity and could be made of the types of materials noted in the aforementioned patents. The base material for the garment would be selected so as to provide comfort to the user. Such material could be a stretch material having four-way or two-way stretch, preferably using a LYCRA® spandex yarn. Other examples are DuPont's TACTEL® and SUPPLEX® textiles. The elastic resistance material would have stretch in at least one direction and would require a force by the user to cause the stretch thereby enhancing the aerobic quality of the material. Reference is being made to the aforenoted patents for use as examples of such materials for elastic resistance bands. A suitable material is a raschel knit containing LYCRA® spandex.

The garment would include at pre-selected locations the elastic resistance bands 17, 18, 19 and 21. Generally, such bands have anchor structure in order to function as an aerobic garment. For example, where used in the shirt portion of the garment the anchor structure might be at the ends of the arms, such as at the hands or wrists. Where used in the pants portion of the garment the anchor structure might be at the legs or feet and might also be at the shoulders. Others locations of anchor structure might also be used with the practice of this invention. For example, a pants portion may terminate at the waist and anchor structure could be provided at the waist. A pants portion might also terminate in the general area of the knees and the anchor structure could be provided at, above or below the knees. With regard to the shirt portion the elastic band could extend from arm to arm with the anchor structure at each arm. Alternatively, the elastic band could extend from one arm to a further portion of the garment such as on the torso, neck or shoulder area and be provided with anchor structure at that area.

In general, the aerobic garment would be made by first designing the garment and determining the body dimensions. Next, the fabric would be selected and patterns would be made. Preferably the first sample would be cut and sewn and then fitted. After this testing any errors in the patterns would be corrected. A second sample would then be cut, sewn and fitted and corrections made for fit, function and patterns. The patterns would be grade and markers made. Specification sheets would be set up and sewing sheets would be created. Cutting tickets would be written and the final garments would be cut and sewn.

In general, the basic fabric would have its section sewn together to form a base unit. The elastic aerobic bands 17, 18, 19 and 21 would then be incorporated into the basic garment by being sewn at the appropriate locations to form a final garment section. A significant feature of the invention is that the elastic bands 17, 18, 19 and 21 are designed so as to minimize the number of pieces required and to avoid seams across the direction of stretch which would otherwise interfere with the performance of the elastic resistance bands 17, 18, 19 and 21. A characteristic of such elastic resistance bands 17, 18, 19 and 21 would be the high modulus required to return the bands when stretched. Thus, a physical exertion is required to stretch the bands and the muscles work to hold or restrain the bands 17, 18, 19 and 21 when the bands 17, 18, 19 and 21 attempt to return to their original unstretched size.

Variations

There are many possible variations of the version described above. One variation is a suit which encloses the entire body including long sleeves and full pant legs. A second variation is a suit which covers only the abdomen. Variations in length of the sweat skirt may accommodate a wide range of requirements and applications. In broad embodiment, the present invention is a sauna suit with integrated sports bra and integrated sweat absorbing panel which affords the user a supportive, aesthetically flattering, and highly functional water weight loss promoting garment.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

The invention claimed is:

1. An aerobic activity garment structure comprising:

a shirt adapted to be worn around a user's trunk, the shirt including a water resistant material adapted to promote perspiration;

a sports bra integrated within the shirt, the sports bra including an elastic polymeric material for increased support of the breasts;

a base portion attached to the shirt portion, the base portion adapted to be worn approximately below the user's trunk;

a closure means for securement of the garment to a wearer, the closure means spanning from the shirt to the base portion; and a moisture-absorbent material lining attached to the base portion, the moisture-absorbent material lining adapted to absorb the perspiration.

2. The aerobic activity garment structure of claim 1 wherein said base portion is in the form of a skirt.

* * * * *